US005222620A

United States Patent [19]

Lima et al.

[11] Patent Number: 5,222,620

[45] Date of Patent: Jun. 29, 1993

[54] DRUM LINER LOCKING AND LOCATING ASSEMBLY

[75] Inventors: William Lima, Monmouth Beach; Earl V. Lind, Brick, both of N.J.

[73] Assignee: Russell-Stanley Corporation, Red Bank, N.J.

[21] Appl. No.: 918,939

[22] Filed: Jul. 22, 1992

Related U.S. Application Data

[63] Continuation of Ser. No. 784,516, Oct. 29, 1991, abandoned.

[51] Int. Cl.[5] ..... B65D 25/20

[52] U.S. Cl. ..... 220/404; 220/465

[58] Field of Search ..... 220/404, 465, 470

[56] References Cited

U.S. PATENT DOCUMENTS

| | | | |
|---|---|---|---|
| 3,167,210 | 1/1965 | Carney, Jr. | 220/63 |
| 3,262,628 | 7/1966 | Heisler et al. | 229/14 |
| 3,409,201 | 11/1968 | Carpenter, Jr. | 229/14 |
| 4,164,304 | 8/1979 | Roberson | 220/465 |
| 4,524,883 | 6/1985 | Herring | 220/465 X |
| 4,635,814 | 1/1987 | Jones | 220/403 |
| 5,046,634 | 9/1991 | McFarlin et al. | 220/404 X |

*Primary Examiner*—Steven M. Pollard

*Attorney, Agent, or Firm*—Hedman, Gibson & Costigan

[57] ABSTRACT

A drum liner locking and locating apparatus is provided for securing a drum liner to a drum. The drum liner apparatus primarily comprises a fitting, a liner, and a non-releasable securing means. The fitting is passed through an opening in the lid of a drum before the lid is attached to the drum. The fitting can only be passed through the opening so that the liner is in a position that the liner can expand to the full size of the drum. After the fitting is in place, the non-releasable securing means fastens the fitting to the drum raising the drum liner to the top of the drum. Consequently, to remove the drum liner, the top of the drum must be removed destroying the drum and prohibiting reconditioning or reuse of the drum.

12 Claims, 3 Drawing Sheets

DRUM LINER LOCKING AND LOCATING ASSEMBLY

This application is a continuation of application Ser. No. 07/784,516, filed Oct. 29, 1991, now abandoned.

FIELD OF THE INVENTION

This invention relates to drum liners which are placed inside of drums to hold hazardous material. More particularly, the invention relates to drum liners which can not be removed from the drum unless the lid of the drum is destructively removed.

BACKGROUND OF THE INVENTION

Liquids and other fluidizable materials have long been shipped and stored in drums. A typical drum is a fifty five gallon drum formed of steel. More recently fifty five gallon drums formed of plastic materials have become common. Both the steel and plastic drums have conventional offset bung holes in the top or lid through which the drums are filled and emptied and vent holes diametrically opposed to the bung holes.

A relatively recent development is the use of flexible drum liners that protect the drum interior from contact with the fluid. Flexible liners are most effective when the liner configuration is identical to the drum interior to facilitate conformity of the liner to the drum interior. One of the problems associated with the use of drum liners is the proper orientation of the liner in the drum. As a result of the offset bung hole in the top of the drum the opening in every liner that conforms to a drum interior must be at a location on the liner to align with the bung hole. If the opening in the liner is misaligned, the liner can not be completely filled and a tension stress will be imposed on the liner.

In addition, historically drums, whether steel or plastic have customarily been reconditioned for reuse. In effect, an entire industry exists to remove all traces of the contents of the drums and safely dispose of the contents. In view of the hazardous nature of many of the liquids found in the drums and the hazardous nature of the chemicals used to recondition the drums, the problem of disposing of the contents in the drums and the liquids used to recondition the drums in an ecologically safe manner has arisen. Consequently, destroying and recycling the drum instead of reconditioning the drum is less detrimental to the environment because hazardous chemicals which damage the environment are not used.

SUMMARY OF THE INVENTION

It is an objective of the invention to provide a drum liner apparatus which can not be removed from a drum unless the lid of the drum is destructively removed.

A further objective of the invention is to ensure that the drum is destroyed when the liner is removed from the drum so that the drum must be recycled instead of being reconditioned.

It is another objective of the invention to provide a drum liner assembly that insures alignment of the drum liner within the drum in an orientation that minimizes stress on the liner and enables complete filling of the liner.

To this end, a drum liner apparatus associated with a drum is comprised of a fitting that passes through the conventional opening in the lid of a drum, a flexible liner that attaches to the fitting and means to secure the fitting to the opening in the lid of the drum.

The fitting has a collar with one thread on the outer surface and two separations in the thread. One separation is wider than the other separation and the thread on the outer surface of the fitting is at an angle. The fitting also has an upper and a lower flange. The upper flange has serrations on the top surface and the lower flange serves to attach the flexible liner to the fitting.

The means for securing the fitting to the opening in the lid of a drum comprises a lock nut which has a single thread with two separations on the interior surface. The nut thread interconnects with the thread on the outer surface of the fitting collar. The thread located on the interior surface of the nut is at an angle opposite to the thread of the outer surface of the fitting. The nut is further comprised of a single continuous array of ratchet boxes located along the periphery of the bottom interior surface of the nut.

The opening in the lid of the drum has two protrusions, wherein the first protrusion is wider than the second protrusion and the protrusions have tabs which bend upwardly from the lid. These tabs interact with the ratchet boxes of the nut to maintain the liner assembly in a fixed non-removable condition on the drum.

In another major aspect, the invention provides a method for attaching the drum liner to a drum comprising the steps of inserting the fitting collar into an opening in the lid of the drum and securing the drum liner to the drum. Attachment of the drum liner to the lid of the drum is effected by aligning the respective separations in the thread in the drum liner fitting with the appropriate respective protrusions in the opening in the lid of the drum.

Securing the drum liner to the drum is completed by placing the lock nut over the drum liner fitting, turning the nut onto the fitting such that the threads of the nut and liner fitting interconnect with each other and the liner fitting is raised to the top of the drum. The ratchet boxes on the lower portion of the nut then bear against the tabs in the lid of the drum as the liner fitting is raised to the top of the drum. When the upper flange of the fitting is compressed against the inner surface of the drum lid the tabs bear against the ratchet boxes thereby permanently securing the fitting to the drum lid.

DESCRIPTION OF THE DRAWINGS

The present invention will be better understood when considered with the accompanying drawings.

DESCRIPTION OF THE PREFERRED EMBODIMENT

Figure 1:
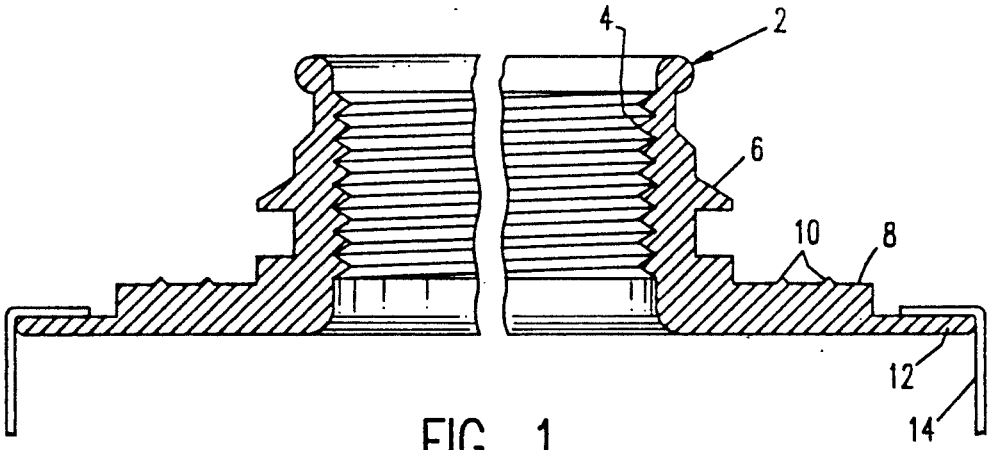
FIG. 1 is a cross-sectional elevational view of the fitting of the drum liner.

The drum liner assembly 1 is primarily comprised of a fitting 2, a liner 14, a lock unit 20 which fastens the fitting 2 to a drum 3 and an opening 32 in the top 30 of the drum 3 through which the fitting 2 passes.

Figure 3:
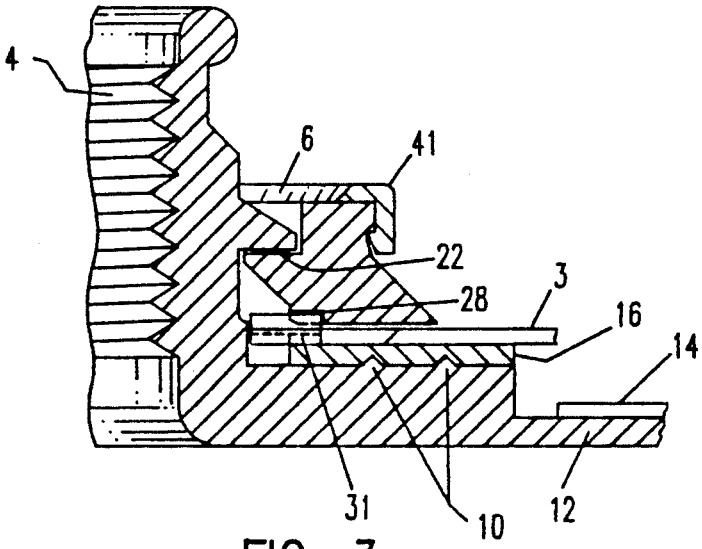
FIG. 3 is a partial cross sectional view of the drum liner of FIG. 1 secured by the lock nut of FIG. 2 to the lid of a drum.
Figure 5:
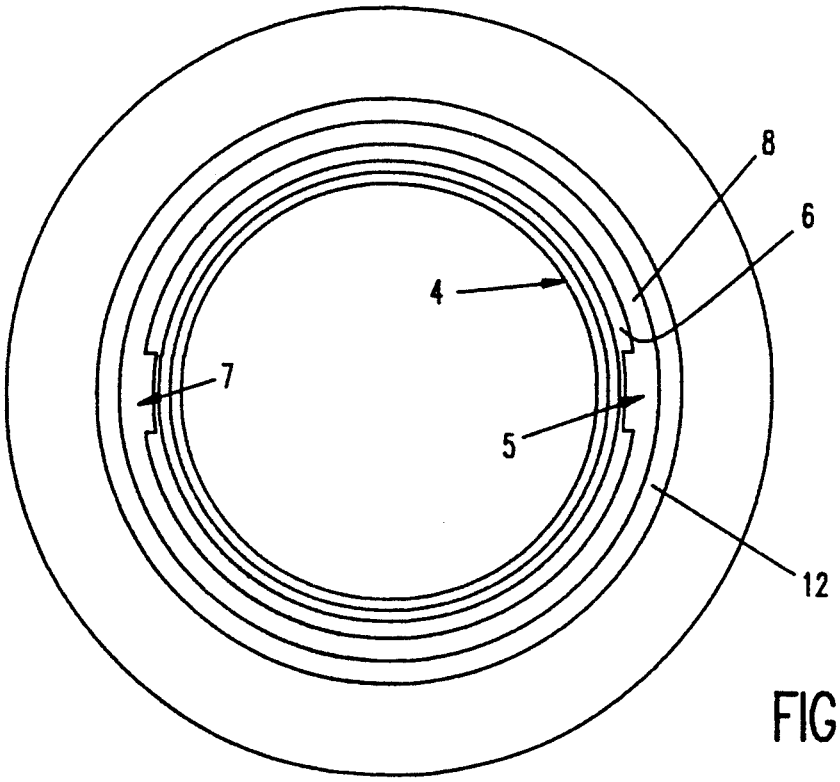
FIG. 5 is the top plan view of the fitting of the drum liner.
Figure 7:
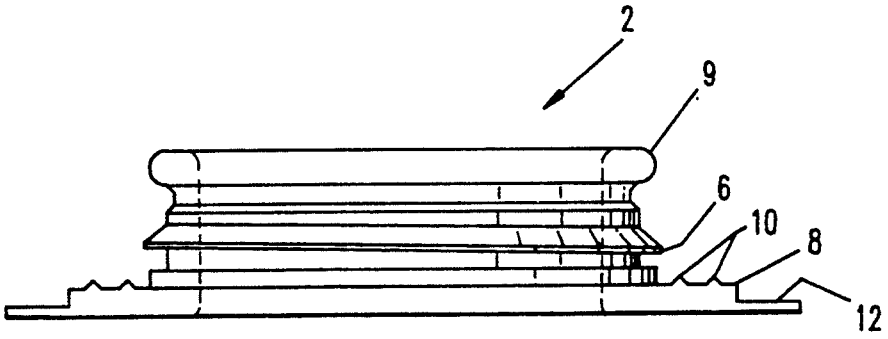
FIG. 7 is a side view of the fitting of the drum liner.

As best seen in FIGS. 1, 3 and 7, the fitting 2 of the drum liner assembly 1 is comprised of a collar 9 with a single thread 6 on the exterior surface of the fitting 2. There are two separations 5 and 7 in the thread 6 wherein the first separation 5 is wider than the second separation 7 as best seen in FIG. 5. The separations 5 and 7 can be located anywhere along the thread 6. The thread 6 on the exterior surface of the fitting 2 is also at an angle along the exterior surface.

There are also two flanges 8 and 12 which are located on the exterior of the fitting 2. The upper flange 8 has teeth or serrations 10 that are provided to hold a gasket 16 which is adapted to fit over the collar 9 of the fitting 2 and bear against the upper flange 8. The liner 14 is attached to the lower flange 12. The fitting 2 and liner 14 may be either integrally formed for example, by means of a typical blow-molding operation or may be separately formed and thereafter fused or otherwise adhered together.

The interior surface of the fitting 2 is provided with conventional threads 4 found in the bung hole of a drum. The threads 4 are adapted to receive the mating threads of a filling or vacuum device.

Figure 2:
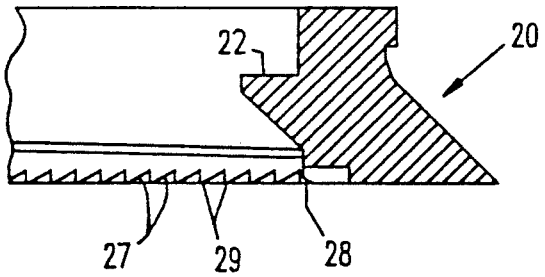
FIG. 2 is a partial cross-sectional view of the lock nut used to secure the drum liner fitting to a drum.
Figure 4:
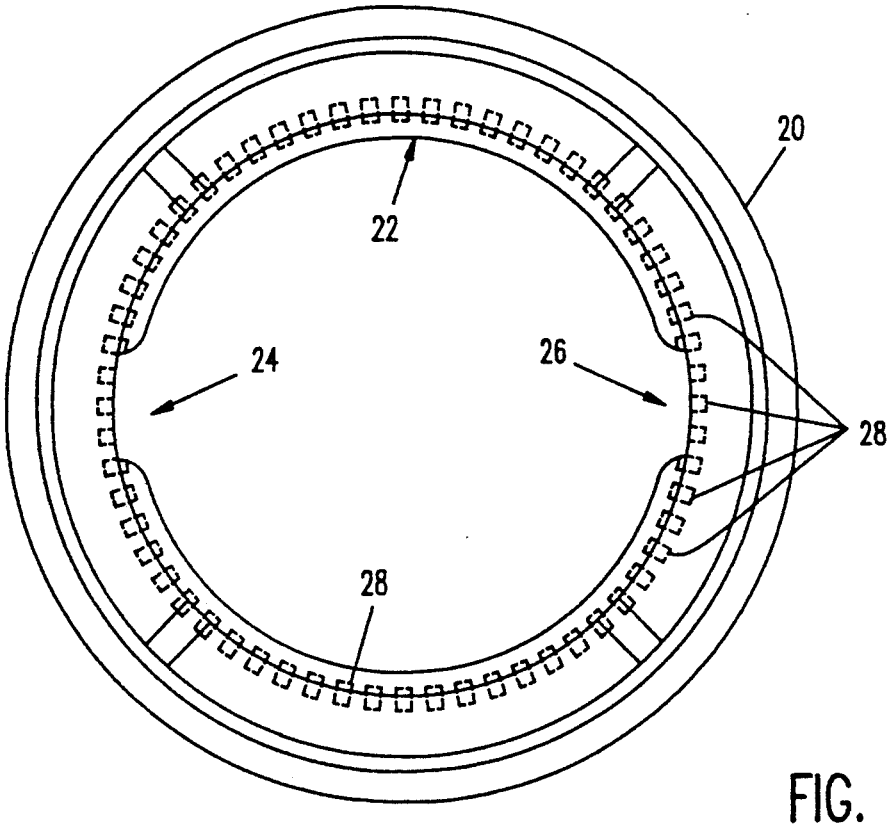
FIG. 4 is the top plan view of the lock nut used to secure the fitting to a drum.

The lock nut 20, best seen in FIGS. 2, 3 and 4 is provided with a single thread 22 on the interior surface of the nut 20. The thread 22 located on the interior surface of the nut 20 is at an angle opposite to the thread 6 on the outer surface of the fitting 2. There are two openings 24, 26 in the thread 22 that can be of the same or different sizes. The openings 24 and 26 can be located anywhere along the circumference of the nut 20, however are preferably located diametrically opposed to each other and are of the same width. The location of the openings 24, 26 are selected to align with the separations 5 and 7 in the thread 6 located on the exterior surface of the fitting 2.

The nut 20 is further comprised of a continuous array of ratchet boxes 28 which are located along the bottom interior periphery of the nut 20. The ratchet boxes 28 are individually configured with an inclined surface 27 and a vertical wall 29 at the end of each inclined surface 27, as best seen in FIG. 2.

Figure 6:
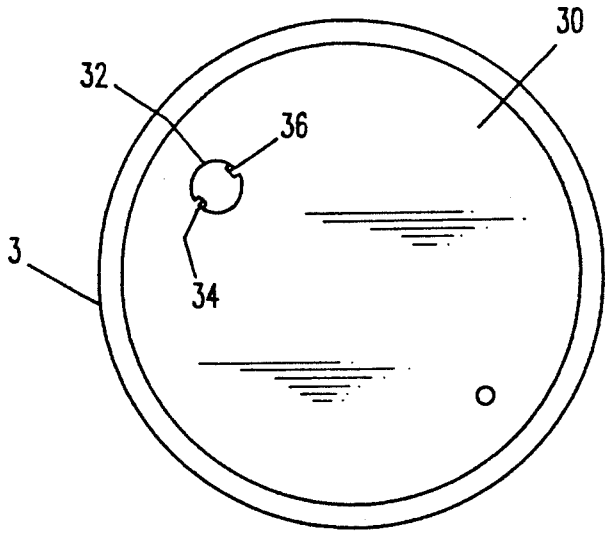
FIG. 6 is the top plan view of a drum with a hole.
Figure 8:
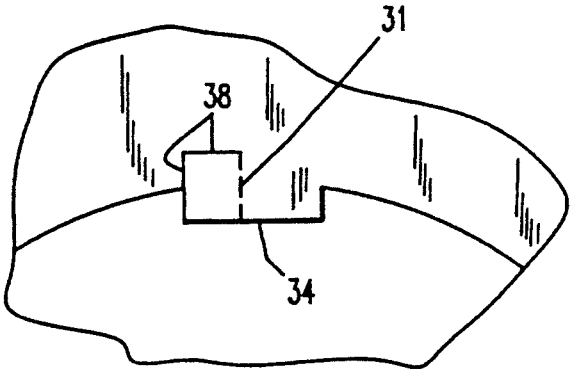
FIG. 8 is a partial plan view of a protrusion and tab.
Figure 9:
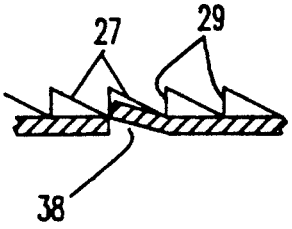
FIG. 9 is a sectional view of a tab engaged with a ratchet tooth.

The drum 3 in which the drum liner 1 is placed has an opening 32 in the top or lid 30 of the drum 3 as seen in FIG. 6. The opening 32 in the lid 30 of the drum 3 is located on the lid 30 of the drum 3 at the conventional bung hole location. The opening 32 in the lid 30 of the drum 3 has two protrusions 34, 36. One protrusion 34 is wider than the other protrusion 36 and can be located anywhere along the circumference of the opening 32, preferably diametrically opposed to the protrusion 36. However, the protrusions 34 and 36 must be oriented to align with the respective separations 5 and 7 in the thread 6 on the fitting 2. The various size protrusions 34 and 36 that extend into the opening 32 of the lid 30 cooperate with the separations 5 and 7 in the fitting 2 to insure the correct positioning of the liner 14 inside the drum 3. Additionally, as best seen in FIGS. 8 and 9, tabs 38 are cut in the protrusions 34 and 36 and bend upwardly from a bend line 31 on each protrusion 34 and 36. The tabs 38 are in alignment with the ratchet boxes 28 formed on the inner periphery of the lock nut 20.

The fitting 2 of the drum liner assembly 1 is secured to the lid 30 of the drum 3 before the lid 30 is attached to the drum 3. The fitting 2 of the drum liner assembly 1 is configured to protrude through the opening 32 in the lid 30 of the drum 3. The fitting 2 is preferably only slightly smaller in diameter than the opening 32 in the lid of the drum 3. However, prior to passing the fitting 2 of the drum liner assembly 1 through the opening 32 in the lid 30 of the drum 3, a gasket 16 is placed over the collar 9 of the fitting 2 on the serrations or teeth 10 of the upper flange 8. The gasket 16 helps form a tighter seal between the lid 30 of the drum 3 and the fitting 2.

When passing the fitting 2 of the drum liner assembly 1 through the opening 32 in the lid 30 the openings 5 and 7 in the thread 6 of the fitting 2 must be aligned with the appropriate respective protrusions 34 and 36 that extend into the opening 32 in the lid 30 of the drum 3. This alignment insures that the orientation of the liner 14 inside of the drum 3 is appropriate to enable the liner 14 to expand properly. Because the opening 32 in the lid 30 of the drum 3 is never located in the center of the lid 30, the drum liner 14 is not symmetrical about the fitting 2. The fitting 2 is attached to the liner 14 at a location that allows the liner 14 to expand to take on the shape of the drum 3 without imposing stress on the liner 14 or fitting 2. If the liner 14 is not aligned correctly, the liner 14 will not expand to its fullest extent and the drum 3 will not be able to hold the required amount of material.

After the fitting 2 is placed into the opening 32 in the lid 30 of the drum, the lock nut 20 is placed over the collar 9 of the fitting 2 to secure the fitting 2 to the lid 30 of the drum 3. The nut 20 is positioned to allow the thread 6 of the fitting 2 and the thread 22 of the nut 20 to interconnect with each other. As the lock nut 20 is torqued against the lid 30 of the drum 3 the gasket 16 is forced up against the inside surface of the lid 30 of the drum 3. The upper flange 8 provides the bearing surface for the gasket 16 and thereby prevents the liner section which is attached to the lower flange 12 from being compressed against the inside surface of the lid 30 of the drum 3. Additionally, by the gasket 16 being forced against the lid 30 of the drum 3 the problem of material leaking between the drum 3 and the liner 14 is alleviated.

While the thread 6 of the fitting 2 is interconnecting with the thread 22 of the nut 20 the ratchet boxes 28 in the nut 20 are interacting with the tabs 38 that are cut in the protrusions 34, 36 in the opening 32 in the lid 30 of the drum 3 as seen in FIGS. 3 and 9. The tabs 38 bend upwardly along a bend line 31 from each protrusion 34 and 36 so that once a ratchet box 28 passes over a tab 38 the lock nut 20 can not be reversed. Consequently, the fitting 2 and liner 14 of the drum liner assembly 1 can not be removed from the drum 3 without destroying the drum 3. This condition prevents the reconditioning and reuse of the drum 3. To remove the drum liner 1 from the drums, the top 30 of the drum 3 must be cut off thereby destroying the drum 3.

Once the nut 20 has been fastened to the fitting 2 a seal cap 41 can be placed over the collar 9 of the fitting 2.

In practice, the drum liner 1 may be formed of any one of a number of materials known in the art such as polyethylene and the drum 3 in the preferred embodiment is formed of steel to provide the most suitable structural material for the tabs 38 that must serve as the reaction member to resist reversal of the lock nut 20.

Practice has shown that suitable dimensions for the assembly are an opening 32 in the lid 30 of approximately 2.95 inches in diameter, protrusions 34 and 36 that are 0.500 and 0.375 inches wide and tabs 38 are 0.187 inches wide and extend 0.100 inches inwardly from the bend lines 31 on the protrusions 34 and 36.

With respect to the fitting 2, the thread 6 that travels along the exterior surface of the fitting 2, is a left hand thread which is angled downwardly at a pitch of eight turns per inch. The two respective openings 5 and 7 in the thread 6 correspond in size and location to the protrusions 34, 36 that extend into the opening 32 in the lid 30 of the drum 3.

The threads 4 along the interior surface of the fitting 2 extend approximately 0.06 inches from the interior surface of fitting 2, each thread travels approximately 0.007 inches along the interior surface of the fitting 2 and the flat portion of each thread which is parallel with the interior surface of the fitting 2 is approximately 0.011 inches.

The fitting 2 has a collar 9 with an outside diameter of 2.94 inches, a lower flange 12 of 4.75 inches diameter and 0.045 inch thickness and an upper flange 8 of 4.0 inch diameter, 0.142 inch thickness and teeth or serrations 10 of 0.02 inches high. The recited dimensions provide a fitting 2 that can be safely secured to the lid 30 of a drum 3 without subjecting the liner 14 to compressive forces from the inside surface of the lid 30 of the drum 3 that might cause abrasion or wear.

As for the lock nut 20, it is sized to thread onto the 2.94 inch fitting outside diameter. The thread 22 along the interior surface of the lock nut 20 is positioned 0.164 inches below the top of the lock nut 20 and extends 0.120 inches from the interior surface of the lock nut 20. This thread 22 is also at an angle which has a pitch of approximately 8 turns per inch so as to interconnect with the thread 6 of the fitting 2. The two openings 24, 26 in the thread 22 are essentially diametrically opposed and of the same width, approximately 0.500 inches. Additionally, there are approximately 60 ratchet boxes 38 along the edge of the nut 20.

The patent application entitled Drum and Process for Handling Drumliners, Ser. No. 07/655,757 filed on Feb. 14, 1991 is incorporated herein by reference. Many obvious variations will suggest themselves to those skilled in the art in light of the above description. All such obvious variations are within the full intended scope of the invention, limited only by the appended claims.

We claim:

1. A drum liner apparatus associated with a drum comprised of:

(a) a fitting which is adapted to pass through an opening in the lid of a drum comprising
  i) a collar;
  ii) at least one thread on the exterior surface of the collar;
  iii) a first separation in the thread;
  iv) a second separation in the thread which is smaller than the first;
  v) an upper flange on the exterior of the fitting which provides a bearing surface for a gasket to prevent the liner from being compressed against the inside surface of the drum lid; and
  vi) a lower flange on the exterior of the fitting to which the drum liner is attached;

b) a flexible liner adapted to attach to the fitting;

c) means for non-releasably securing the fitting to an opening in the lid of a drum; and d) a first and a second protrusion, extending upwardly from the opening in the lid of the drum, where the second protrusion is smaller than the first and the first and second protrusion fit into the first and second separation on the collar for aligning the flexible liner within the drum.

2. A drum liner as in claim 1, wherein the fitting further comprises a thread on the inner surface of the fitting.

3. A drum liner as in claim 2, wherein the thread on the exterior surface of the fitting is at an angle.

4. A drum liner as in claim 1, wherein the upper flange has serrations on the top surface.

5. A drum liner as in claim 1, wherein the means for non-releasably securing the fitting to an opening in the lid of a drum comprises a lock nut which has a single thread with two separations on the interior surface of the non-releasable securing means.

6. A drum liner as in claim 5, wherein the thread located on the interior surface of the lock nut is at an angle which is opposite to the angle of the thread on the exterior surface of the fitting.

7. A drum liner as in claim 5, wherein the lock nut is further comprised of a continuous array of ratchet boxes arranged on the inner periphery of the lock nut.

8. A drum liner as in claim 1, wherein the fitting is made of low density polyethylene.

9. A process for attaching a drum liner apparatus to a drum comprising the steps of:

(a) inserting a drum liner fitting comprising:
  i) a collar;
  ii) at least one thread on the exterior surface of the collar;
  iii) a first separation in the thread;
  iv) a second separation in the thread which is smaller than the first;
  v) an upper flange on the exterior of the fitting which provides a bearing surface for a gasket to prevent the liner from being compressed against the inside surface of the drum lid; and
  vi) a lower flange on the exterior of the fitting to which the drum liner is attached, into an opening in the lid of the drum;

(b) aligning the differently sized separations in the thread with correspondingly sized upwardly projecting protrusions in the opening in the lid of the drum to properly align the drum liner in the drum; and (c) non-releasably securing the drum liner to the drum.

10. A process as in claim 9, wherein securing the drum liner to the drum is perfomed by placing a non-releasable securing means on the liner fitting.

11. A process as in claim 10 further comprising the step of turning the non-releasable securing means onto the fitting and raising the drum liner to the top of the drum.

12. A process as in claim 9 further comprising the step of rotating ratchet boxes on the non-releasable securing means over a tab in a lid of the drum.

* * * * *